US005628225A

United States Patent [19]

Morita

[11] Patent Number: 5,628,225

[45] Date of Patent: May 13, 1997

[54] LEAF SPRING CAMBERING APPARATUS

[75] Inventor: Motoo Morita, Nagoya, Japan

[73] Assignee: Morita and Company Co., Ltd., Aichi, Japan

[21] Appl. No.: 408,917

[22] Filed: Mar. 22, 1995

[30] Foreign Application Priority Data

Jul. 13, 1994 [JP] Japan ..... 6-185444

[51] Int. Cl.[6] ..... B21D 7/00; B21D 53/88

[52] U.S. Cl. ..... 72/413

[58] Field of Search ..... 72/413, 412, 446, 72/477, 473

[56] References Cited

U.S. PATENT DOCUMENTS

| | | | |
|---|---|---|---|
| 483,094 | 9/1892 | Ansted | 72/413 |
| 1,776,082 | 9/1930 | Peterson | 72/413 |
| 5,224,370 | 7/1993 | Morita | 72/413 |

FOREIGN PATENT DOCUMENTS

| | | | |
|---|---|---|---|
| 1242393 | 8/1971 | United Kingdom | 72/413 |

*Primary Examiner*—Daniel C. Crane

*Attorney, Agent, or Firm*—Koda and Androlia

[57] ABSTRACT

Disclosed is a cambering apparatus for imparting a predetermined camber to a leaf spring blank loaded between a pair of dies opposing vertically to each other by bringing the dies closer relative to each other; the apparatus comprising an upper variable die and a lower variable die; the upper variable die essentially consisting of a multiplicity of upper supporting members disposed on upper guide members to be slidable in the longitudinal direction thereof; and a multiplicity of upper shaping fingers fitted descendably in U-shaped grooves defined on the upper supporting members, respectively; whereas the lower variable die consisting essentially of a multiplicity of lower supporting members disposed on lower guide members to be slidable in the longitudinal direction thereof; and a multiplicity of lower shaping fingers fitted ascendably in U-shaped grooves defined in the lower supporting members, respectively; wherein the shaping fingers are ascended or descended to be positioned onto the supporting members respectively by a die shaping device disposed in the main body frame so as to form a predetermined die profile by each of the upper and lower groups of shaping fingers along the opposing ends of the groups of shaping fingers.

3 Claims, 11 Drawing Sheets

LEAF SPRING CAMBERING APPARATUS

BACKGROUND OF THE INVENTION

This invention relates to a cambering apparatus provided with variable dies, in which the camber profile to be imparted thereby to leaf spring blanks can be changed in a short time.

Suspension systems consisting of a plurality of leaves 10 which are laminated and bound as shown in FIG. 13 are suitably employed in land transportation vehicles such as railway cars and trucks. Each of the leaves 10 can be prepared, for example; after formation of an eye at one end portion or each end portion of a rolled plate blank having a predetermined thickness or a taper at the other end portion thereof, by subjecting the thus processed blank, which is heated entirely, to a cambering treatment so as to be provided with a predetermined camber. The camber to be imparted to the blank varies depending on the application and load stress to be applied thereto: a type in which the camber angle gradually diminishes or increases from the center toward each end, a type in which the middle portion has no camber, etc.

FIG. 14 shows one example of prior art cambering apparatus 12 for imparting a camber to a leaf spring blank 10. The cambering apparatus 12 basically consists of an upper die 14 and a lower die 16. The upper die 14 is a female mold, whereas the lower die 16 is a male mold. A straight leaf spring blank 10 heated to a hot working temperature is placed between the upper die 14 and the lower die 16, and then the upper die 14 is forced to approach the lower die 16 to impart a camber conforming to the profile of these dies 14,16.

The mode of manufacturing leaf springs 10 includes:

(1) Group production mode in which leaves 10 of the same shape and the same specifications are continuously manufactured by the group lot; and (2) Family production mode in which a main leaf 10 and the other leaves 10 constituting a suspension system are manufactured by the family lot. A suitable production mode is selected by users .depending on the application and other factors. In the group production mode, after a predetermined large lot number of leaves 10 of the same shape are manufactured, the upper die 14 and the lower die 16 in the cambering apparatus 12 are changed only when a different camber profile is to be imparted in accordance with an order change. It generally takes much time for the change-over of molds, which is a main factor of notably reducing efficiency in cambering leaf spring blanks 10. Particularly today when small lot production is prevalent, countermeasures must be taken for possible frequent order changes, and it is becoming extremely important to minimize the mold change-over time in the laminated spring manufacturing industry.

Meanwhile, in the family production mode, each time a leaf spring blank 10 is cambered, the upper die 14 and the lower die 16 must be changed, since the camber to be imparted to each leaf spring blank is slightly different. Accordingly, this mode also suffers a disadvantage in that it requires extremely intricate procedures and also a considerable loss time. In this regard, the conventional cambering apparatuses are far from satisfaction for meeting the demand of the industry. Further, various kinds of upper dies 14 and lower dies 16 corresponding to the different camber profiles are necessary in the group production mode and the family production mode, leading to production cost elevation. Moreover, inconveniences can be pointed out that the upper dies 14 and lower dies 16 must be stored separately, so that a wide space is required for the storage of these dies and that stock management becomes troublesome. Besides, if the upper dies 14 and the lower dies 16 are used over a long period, it sometimes happens that the molding surfaces thereof wear with time and are deformed to be unable to impart accurate camber to leaf spring blanks 10. In such cases, while the dies 14,16 must be repaired or replaced with new ones, the procedures of repairing or replacing the dies take much time, causing reduction in the production efficiency.

Under such circumstances, the present applicant previously filed an application of an invention entitled "Leaf spring blank cambering method and apparatus therefor" as a proposal for coping with the problems described above. In the cambering apparatus according to this previous application, a holder is ascendably disposed on a base frame constituting the main body of the apparatus, and a multiplicity of shaping fingers are disposed on the holder to be movable in the vertical direction. The positions of the respective shaping fingers are adapted to be adjusted via corresponding servo motors and screw shafts provided on the holder so that a predetermined camber profile may be formed as a whole by the free ends of the group of shaping fingers. According to the cambering apparatus of such constitution, when the camber profile to be imparted to leaf spring blanks is changed in accordance with an order change, the positions of the plurality of shaping fingers may only be adjusted, and thus the time required for the set-up change can be reduced. Besides, there is no need of providing various shapes of moldes, leading to easy stock management and eliminating repair or replacement of dies.

However, this type of cambering apparatus also involves problems in that it is not only expensive but also the mechanism thereof is complicated, because the servo motors for adjusting the positions of the shaping fingers are disposed corresponding to the number of shaping fingers. Further, while a great load is applied to the shaping fingers when a leaf spring blank is to be cambered by the shaping fingers, the screw shafts for adjusting the positions of the fingers are also subjected to such load and are liable to be damaged.

OBJECT AND SUMMARY OF THE INVENTION

The present invention is proposed in view of the problems inherent in cambering leaf spring blanks and for solving them successfully, and it is an objective of this invention to provide an inexpensive cambering apparatus having a simple structure, which can reduce the time required for set-up change in accordance with order changes.

In order to overcome the above problems and attain the intended object suitably, this invention provides a cambering apparatus for imparting a predetermined camber to a leaf spring blank loaded between a pair of dies opposing vertically to each other by bringing the dies closer relative to each other; the apparatus essentially comprising an upper variable die and a lower variable die; the upper variable die consisting of a pair of upper guide members secured on a movable frame descendably disposed on a main body frame, and extended in the longitudinal direction of the leaf spring blank a multiplicity of upper supporting members disposed on the upper guide members to be slidable in the longitudinal direction thereof an upper shaping finger fitted descendably in a U-shaped groove defined on that side of each upper supporting member which opposes to one of adjacent two upper supporting members a regulating member disposed in each of the upper supporting members, which is normally abutted against a corresponding upper shaping finger locating in the U-shaped groove and which can be shifted by a releasing means to a position where it allows descending of the upper shaping finger; and a pair of releasable upper immobilizing means disposed on the movable frame, which bring the multiplicity of upper supporting members into press contact with one another so as to unmovably position the group of upper shaping fingers whereas the lower variable die consisting of a pair of lower guide members secured on a fixed frame disposed on the main body frame and under the movable frame so as to oppose vertically thereto and extended in the longitudinal direction of the leaf spring blank a multiplicity of lower supporting members disposed on the lower guide members to be slidable in the longitudinal direction thereof a lower shaping finger fitted ascendably in a U-shaped groove defined on that side of each lower supporting member which opposes to one of adjacent two lower supporting members a regulating member disposed in each of the lower supporting members, which is normally abutted against a corresponding lower shaping finger locating in the U-shaped groove and which can be shifted by a releasing means to a position where it allows descending of the lower shaping finger a pair of releasable lower immobilizing means disposed on the fixed frame, which bring the multiplicity of lower supporting members into press contact with one another so as to unmovably position the group of lower shaping fingers wherein the shaping fingers in the upper and lower variable dies are ascended or descended to be positioned onto the supporting members respectively by a die shaping device disposed in the main body frame so as to form a predetermined die profile by each of the upper and lower groups of shaping fingers along the opposing ends of the upper and lower groups of shaping fingers.

BRIEF DESCRIPTION OF THE DRAWINGS

The features of this invention that are believed to be novel are set forth with particularity in the appended claims. The invention, together with the objects and advantages thereof, may best be understood by reference to the following description of the preferred embodiments taken in conjunction with the accompanying drawings in which:

DETAILED DESCRIPTION OF THE INVENTION

The leaf spring blank cambering apparatus according to the present invention will now be described by way of a preferred embodiment referring to the attached drawings. It should be noted here that the expressions "front", "rear", "left" and "right" are used in the following description with respect to FIG. 1, for convenience's sake.

(Entire constitution)

Figure 1:
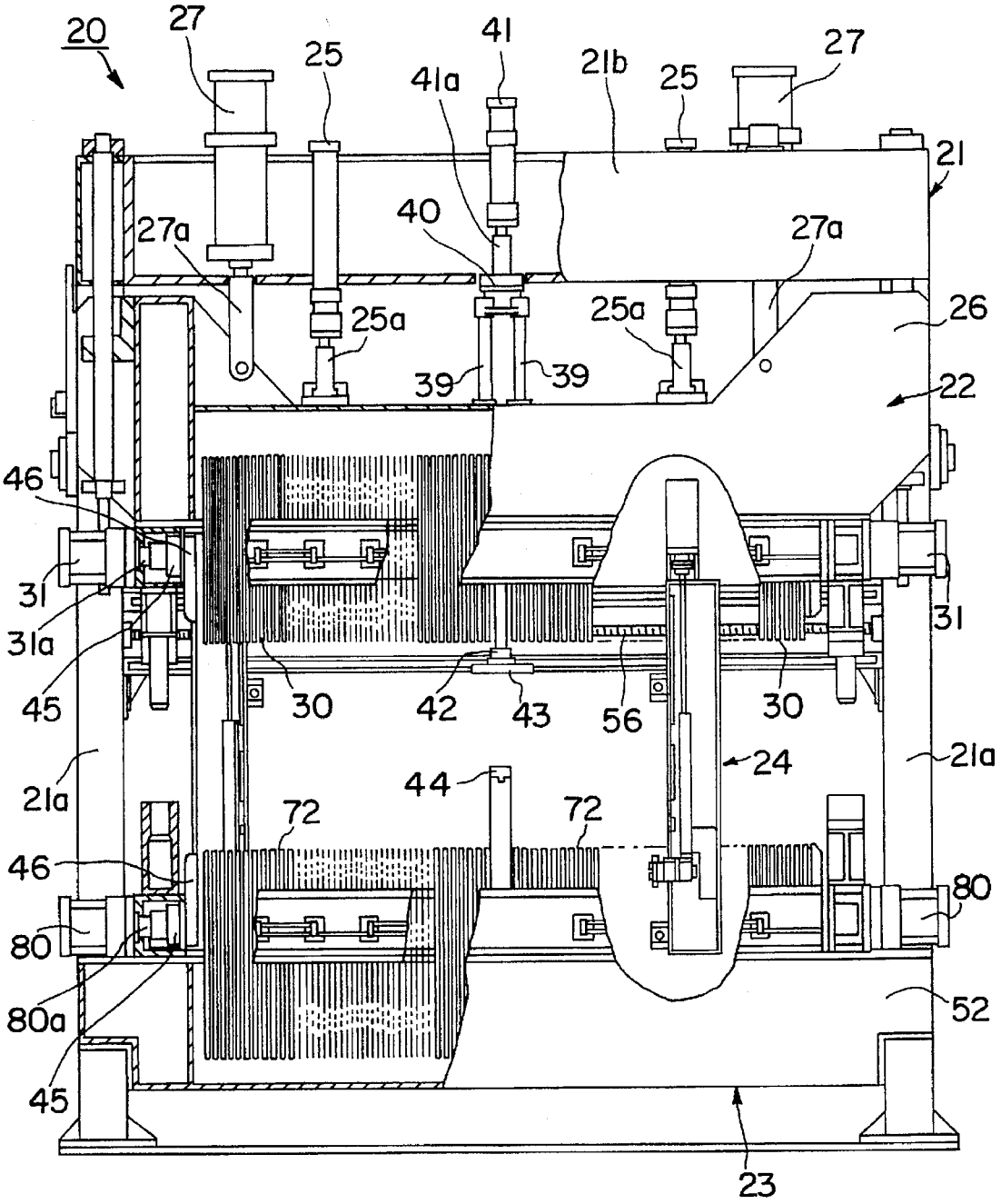
FIG. 1 is a front view showing schematically the constitution of the leaf spring blank cambering apparatus according to one embodiment of the invention.

FIG. 1 is a constitutional view showing schematically a preferred embodiment of the cambering apparatus according to this invention. The cambering apparatus 20 has a gate-like main body frame 21 and provided thereon with an upper variable die 22 constituting an upper die, a lower variable die 23 constituting a lower die and a couple of die shaping devices 24 for forming predetermined die profiles by the opposing faces of these two dies 22,23. A leaf spring blank 10 is fed between the upper variable die 22 and the lower variable die 23 by a transferring device (not shown) like a manipulator from the previous step, and then the upper variable die 22 is forced to approach the lower variable die 23 so as to impart a predetermined camber to the leaf spring blank 10 (see FIG. 12).

(Upper variable die)

Figure 2:
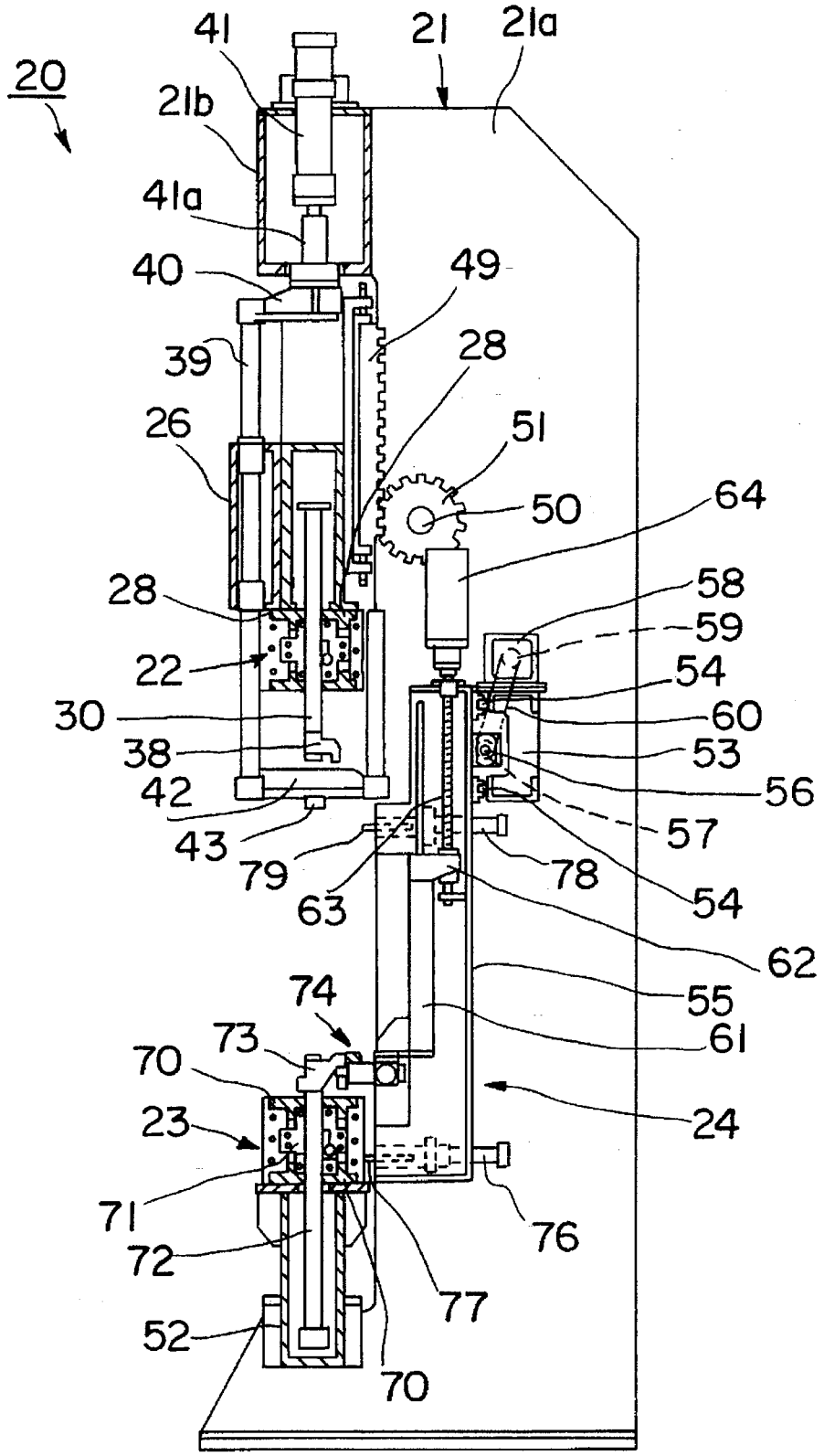
FIG. 2 is a vertical cross-sectional side view of the cambering apparatus.

A beam 21*b* is extended between a right pillar 21*a* and a left pillar 21*a* of the main body frame 21 so as to project from the upper front faces thereof, as shown in FIG. 2, and a pair of hydraulic cylinders 25 are disposed invertedly to be spaced from each other in the longitudinal direction of this beam 21*b*. Further, a movable frame 26 constituting the upper variable die 22 is descendably disposed between these two pillars 21*a* and under the beam 21*b*, and the piston rods 25*a* of the hydraulic cylinders 25 are connected to the upper surface of a movable frame 26. Accordingly, the movable frame 26 (upper variable die 22) can be ascended or descended parallel to the pillars 21*a* by synchronously operating the hydraulic cylinders 25 in the positive or negative direction (see FIGS. 11 and 12). Incidentally, the hydraulic cylinders 25 are adapted to be able to position the upper variable die 22 at the position where the dies are to be adjusted by the die shaping devices 24 and also to be able to descend the upper variable die 22 to the position where a camber profile is to be imparted to the leaf spring blank 10. A pair of air cylinders 27 are invertedly disposed respectively at outer positions of the hydraulic cylinders 25, and the piston rod 27*a* of the air cylinders 27 are connected to the movable frame 26. The air cylinders 27 function to keep balance of the movable frame 26 when it is ascended or descended.

Figure 3:
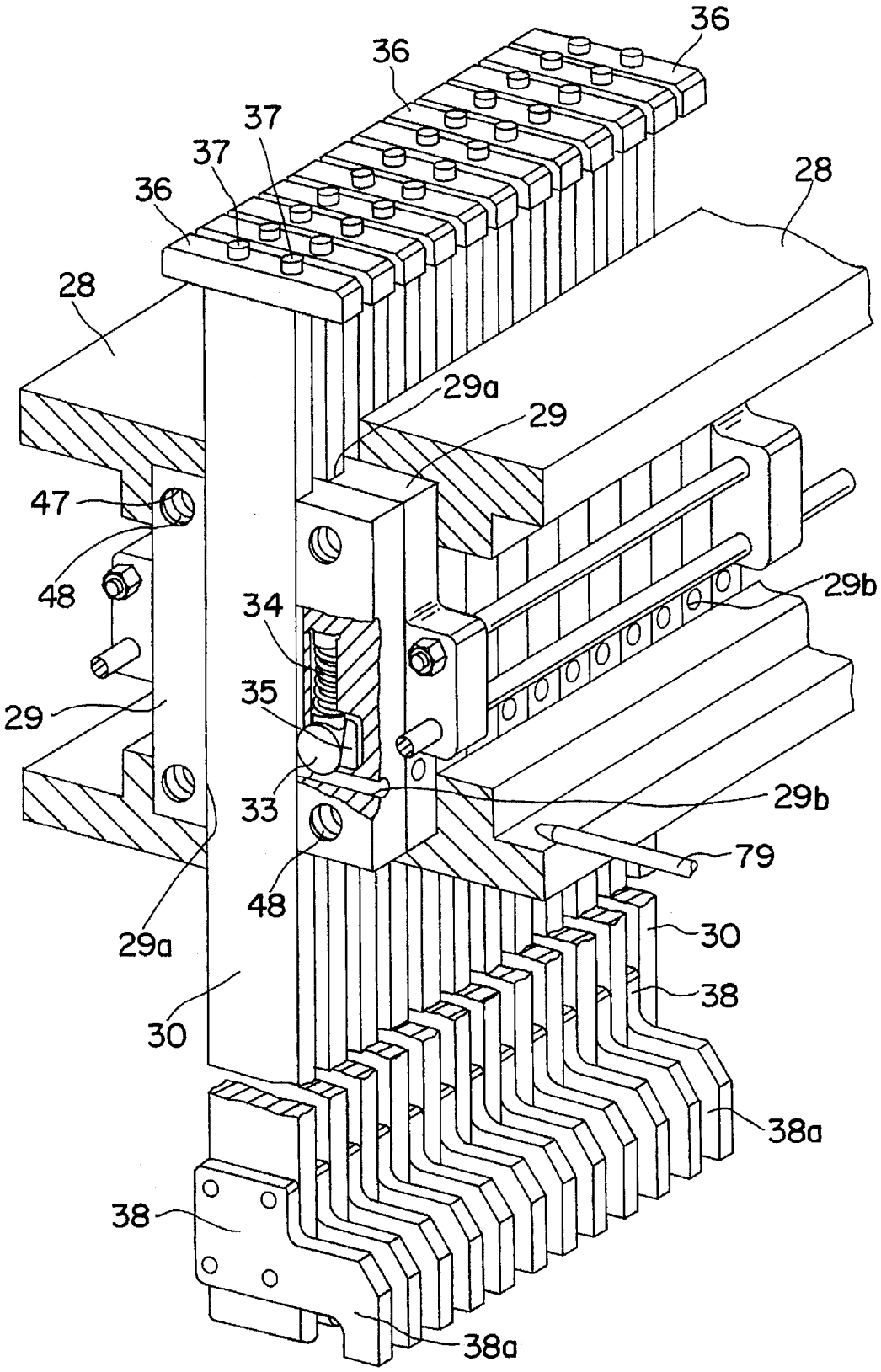
FIG. 3 is a perspective view showing schematically the major section of an upper variable die.

As shown in FIG. 2, a pair of upper guide members 28 extending in the longitudinal direction of the movable frame 26 are disposed to oppose to each other on the movable frame 26 on the front side and the rear side thereof, respectively, with a predetermined space being secured therebetween. A multiplicity of rectangular upper supporting members 29 are disposed between these guide members 28 to be slidable in the longitudinal direction of the upper guide members 28. A U-shaped groove 29*a* is defined to extend vertically on one lateral surface of each upper supporting member 29 opposing to one adjacent upper supporting member (the lateral surface orthogonal to the thickness thereof), as shown in FIG. 3, and a plate-like upper shaping finger 30 is fitted in this U-shaped groove 29*a* to be slidable in the vertical direction. Incidentally, the depth of the U-shaped groove 29*a* is designed to be slightly smaller than the thickness of the upper shaping finger 30, so that the upper supporting members 29 may nip the upper shaping fingers 30 to be immobilized therebetween when the multiplicity of upper supporting members 29 are pressed together by a pair of upper hydraulic cylinders 31 (to be described later).

Figure 8A:
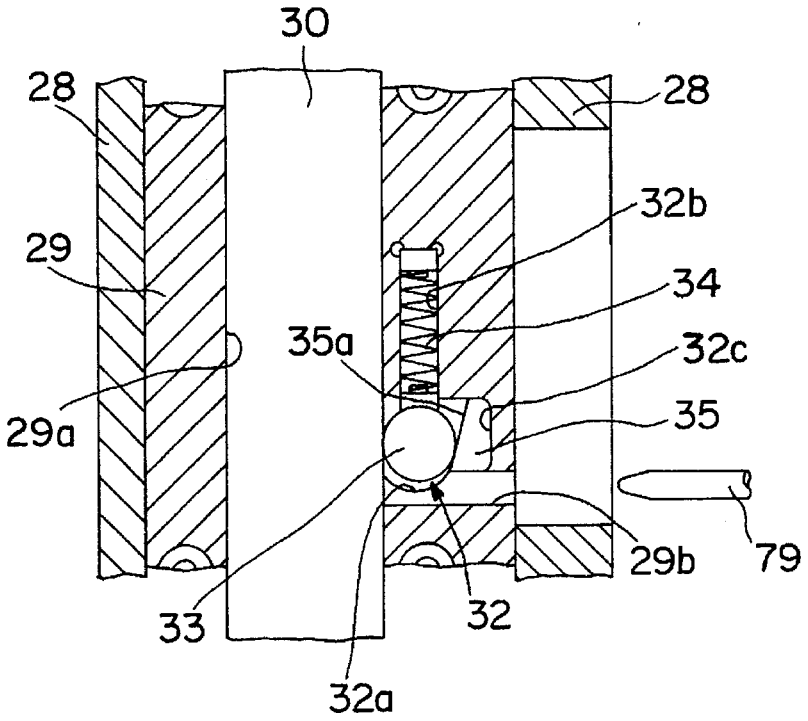
FIG. 8(*a*) and 8(*b*) are explanatory view of a shift regulating mechanism disposed in the upper supporting member, showing the states where regulation against descending of the upper shaping finger is applied and released, respectively.
Figure 8B:
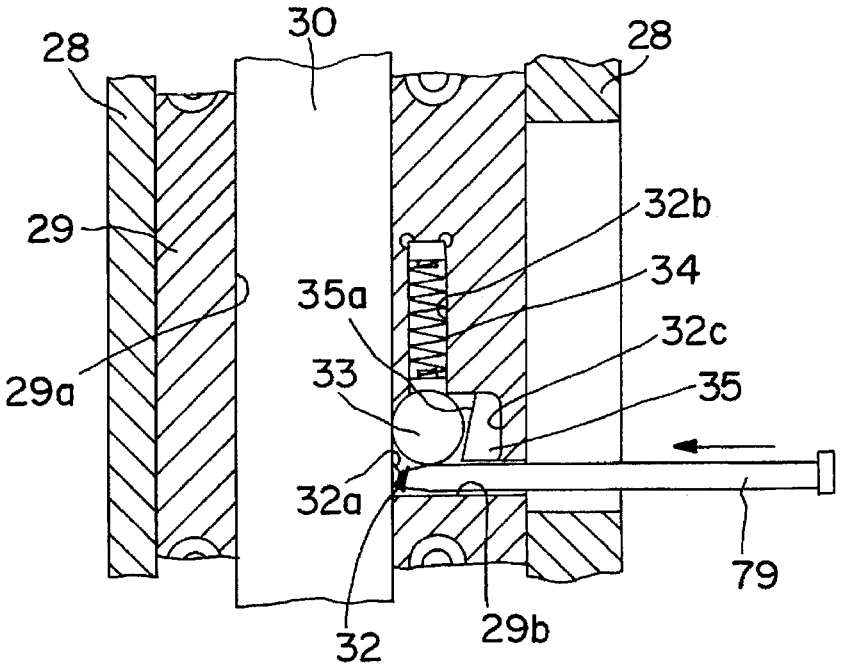

A recess 32 having the illustrated profile is defined in the upper supporting member 29 immediately behind the U-shaped groove 29*a*, as shown in FIG. 8, in which a mechanism for regulating shifting of the upper shaping finger 30 is accommodated. The recess 32 consists of a first accommodating section 32*a* opening to the U-shaped groove 29*a*, a vertical hole 32*b* communicating to the upper portion of the first accommodating section 32*a* and a second accommodating section 32*c* defined adjacent to the first accommodating section 32*a* at a position farther from the U-shaped. groove 29*a* than the position of the first accommodating section 32*a*. A cylindrical body 33 having a predetermined diameter is accommodated in the first accommodating section 32*a* and is adapted to be constantly urged downward under the resilience of a compression spring 34 accommodated in the vertical hole 32*b*. Further, a wedge 35, which can be abutted against the circumference of the cylindrical body 33, is accommodated in the second accommodating section 32*a*. The surface of the wedge 35 opposing to the cylindrical body 33 is sloped down to be closer to the U-shaped groove 29*a*. Namely, in the state where the cylindrical body 33 is urged downward by the compression spring 34, the cylindrical body 33 is guided closer to the U-shaped groove 29*a* along the sloped surface 35*a* of the wedge 35 and pressed against the lateral surface of the upper shaping finger 30 fitted in the U-shaped groove 29*a*. Thus, descending of the upper shaping finger 30 with respect to the upper supporting member 29 is adapted to be regulated. Incidentally, in this state, ascending of the upper shaping finger 30 with respect to the upper supporting member 29 is not regulated.

A through hole 29*b*, which communicates to the first accommodating section 32*a* in the recess 32, is defined in each upper supporting member 29 to open to the rear surface thereof, so that the cylindrical body 33 may be moved upward against the resilience of the compression spring 34 by inserting a release pin 79 of a releasing device (to be described later) into the through hole 29*b*, as shown in FIG. 8(*b*). In such case, the cylindrical body 33 moves along the sloped surface 35*a* of the wedge 35 to be spaced from the U-shaped groove 29*a*, and thus the regulation applied against downward shifting of the upper shaping finger 30 is released. Incidentally, the rear upper guide member 28 is designed to have a shape which allows insertion of the release pin 79 into the through hole 29*b* (see FIG. 3). Further, the wedge 35 provided in the recess 32 is not an essential constituent, but the sloped surface may be formed directly on the inner surface of the recess 32 so that the cylindrical body 33 can move along this sloped surface.

Each upper shaping finger 30 has an elongated plate-like form, as shown in FIG. 3, and a stopper 36 for preventing slipping thereof from the U-shaped groove 29*a* of the corresponding upper supporting member 29 is fixed onto the upper end of the upper shaping finger 30 by a plurality of bolts 37. An upper side plate 38 is provided near the lower end portion of each upper shaping finger 30 on the surface outer than the location of the U-shaped groove 29*a* in such a way that the outer surface orthogonal to the, thickness of the upper side plate 38 may be abutted against the lateral surface of the adjacent upper shaping finger 30. Further, an engagement piece 38*a* is formed integrally with the upper side plate 38 so as to extend toward the rear side of the upper shaping finger 30, and a similar engagement piece 73*a* of a lower side plate 73 provided on a lower shaping finger 72 in the lower variable mold 23 is designed to be able to be abutted upward against this engagement piece 38*a*. In the state where these two engagement pieces 38*a* and 73*a* are abutted against each other, the position of the upper shaping finger 30 is adapted to be adjusted by the die shaping devices 24 (see FIGS. 9 and 10).

A positioning cylinder 41 is disposed invertedly at the center of the beam 21 with respect to the longitudinal direction thereof, and the piston rod 41*a* of the cylinder 41 is connected to an upper holding member 40 locating between the beam 21*b* and the movable frame 26. As shown in FIGS. 1 and 2, the upper ends of a plurality of guide rods 39 descendably disposed on the movable frame 26 are immobilized onto this upper holding member 40. Meanwhile, a lower holding member 42 is disposed to the lower ends of the guide rods 39 extending below the movable frame 26, and an upper reference finger 43 is provided on the lower holding member 42 at a position in alignment with the upper shaping fingers 30. Thus, the leaf spring blank 10 is designed to be nipped at the longitudinal center thereof between the upper reference finger 43 and a lower reference finger 44 provided on the lower variable die 23, when the positioning cylinder 41 is operated to descend the upper reference finger 43.

A pair of hydraulic cylinders 31 are disposed on the right and left lateral sides of the movable frame 26 at the positions corresponding to the locations of the upper guide members 28, as shown in FIG. 1. A pressing head 45, which is disposed to the piston rod 31*a* of each hydraulic cylinder 31, is adapted to be abutted against a corresponding pusher 46 disposed on the upper guide members 28 to be slidable in the longitudinal direction thereof. By operating the upper hydraulic cylinders 31 so as to extend the piston rods 31*a* thereof outward, the group of upper supporting members 29 disposed on the upper guide members 28 are pressed toward the center via the pushers 46, and thus the upper shaping fingers 30 positioned onto the respective supporting members 29 are unmovably supported to maintain their posture in the fixed state (see FIG. 11).

Figure 4:
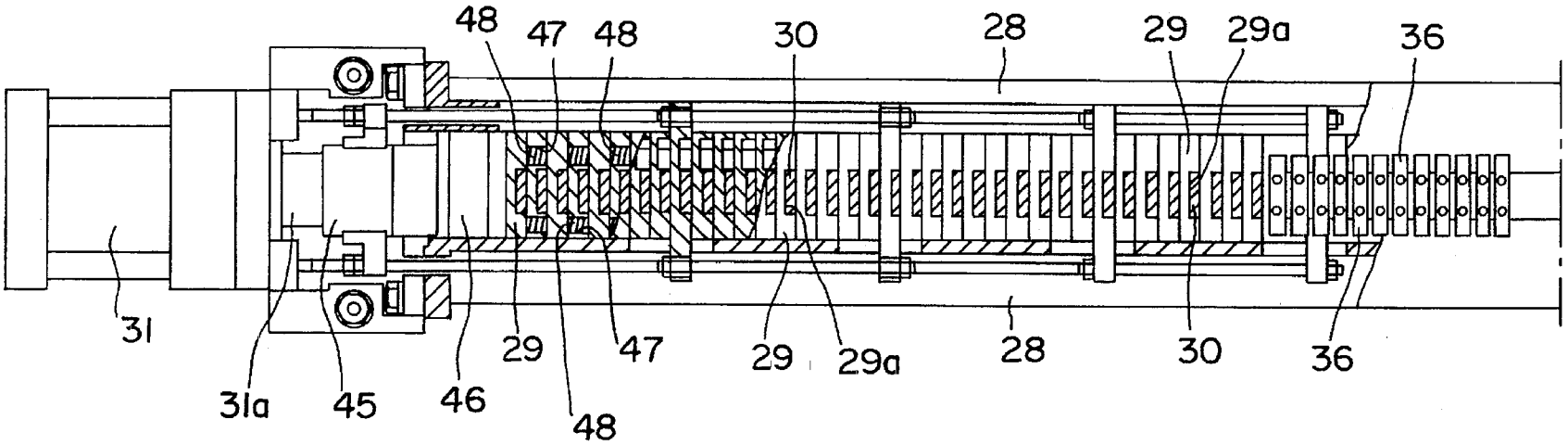
FIG. 4 is a partially cut-away plan view of the major section of the upper variable die.
Figure 5:
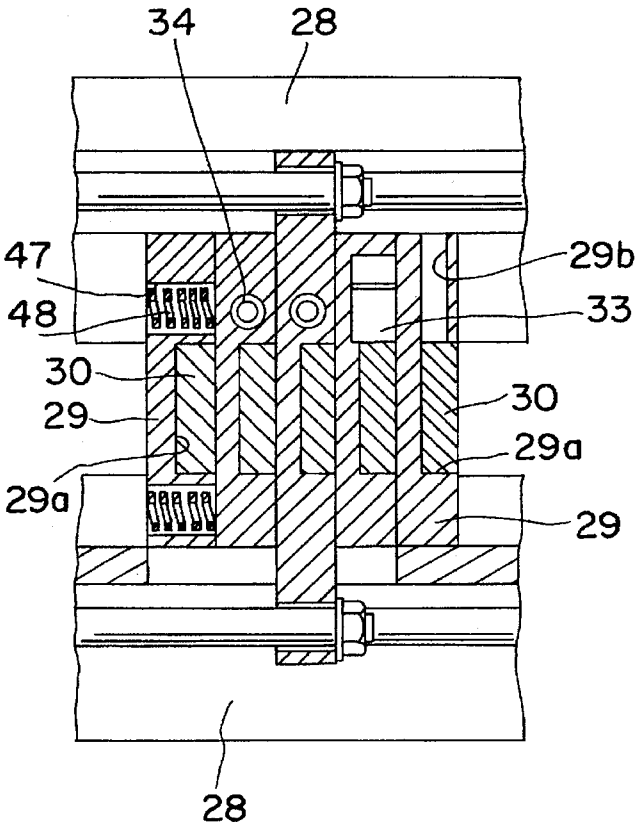
FIG. 5 is a horizontal cross-sectional view of upper supporting members in the upper variable die.
Figure 6:
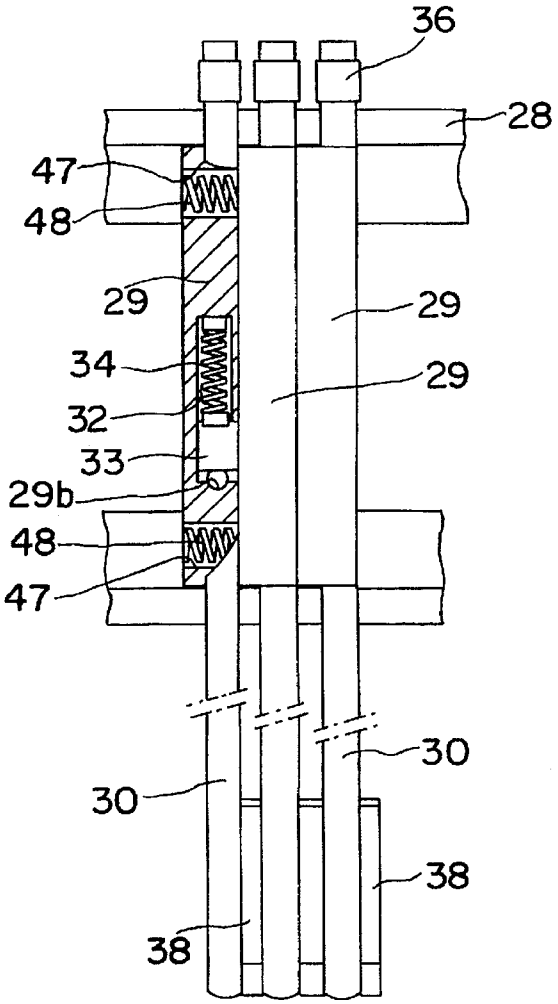
FIG. 6 is a partially cut-away side view of the major section of the upper supporting member in the upper variable die.

Of the multiplicity of upper supporting members 29 disposed slidably along the upper guide members 28, every other upper supporting members 29 each have a plurality of through holes 47 (four in this embodiment) penetrating in the moving direction thereof, as shown in FIGS. 4 to 6, and a compression spring 48 is fitted in each through hole 47 so that it may urge the upper supporting members 29 locating on each side of the upper supporting member 29 having such through holes 47 to be father therefrom. Namely, clearances are allowed to be positively formed between the adjacent upper supporting members 29 with the aid of the compression springs 48 when the nipping force applied by the upper hydraulic cylinders 31 is released (when the piston rods 31*a* are retracted into the barrels), whereby to facilitate adjustment of the position of the upper shaping finger 30 disposed on the supporting member 29.

A pair of racks 49 (only one rack is shown in FIG. 2) are disposed to extend in the vertical direction on the rear surface of the movable frame 26 and spaced from each other in the longitudinal direction thereof, and the racks 49 mesh with pinions 51 fitted to be integrally rotatable with a supporting shaft 50 rotatably supported between the pillars 21*a*. Namely, the racks 49 and pinions 51 function to prevent the movable frame 26 from tilting in the longitudinal direction when it is ascended or descended. Incidentally, the stroke that the movable frame 26 is ascended or descended can be detected, for example, by allowing a pinion of an encoder disposed on one pillar 21*a* with the rack 49 disposed on the movable frame 26.

(Lower variable die)

The lower variable die 23 is disposed on the main body frame 21 correspondingly with the upper variable die 22. It should be noted that the constitution of the lower variable die 23 is basically the same as that of the upper variable die 22, so that only differences will be described here. Further, those members similar to the members constituting the upper variable die 22 are affixed with the same numbers respectively, except for the principle members. To describe in detail, a fixed frame 52 is immobilized at a lower position of the main body frame 21 and between the pillars 21*a* to be parallel and to oppose to the movable frame 26, as shown in FIGS. 1 and 2. A pair of lower guide members 70 are disposed parallelwise on the upper surface of the fixed frame 52 with a plurality of lower supporting members 71 being disposed slidably between these two guide members 70. A lower shaping finger 72 is disposed to each lower supporting member 71 in such a state that descending of the lower shaping finger 72 may be regulated by a shift regulating mechanism. The lower shaping fingers 72 positioned onto the respective lower supporting members 71 are designed to be maintained in the fixed state by operating a pair of lower hydraulic cylinders 80 disposed at each longitudinal end of the lower guide members 70. A lower side plate 73 is provided near the upper end portion of each lower shaping finger 72, and an engagement piece 73*a* is formed integrally therewith so as to extend toward the rear side of the lower shaping finger 72. The engagement pieces 73*a* are designed to be abutted against the engagement pieces 38*a* of the upper side plates 38 provided on the respective upper shaping fingers 30. Further, a lower reference finger 44 stands at the longitudinal center of the fixed frame 52 at a position corresponding to the location of the upper reference finger 43. The leaf spring blank 10 forwarded from the previous step by a transferring mechanism is to be loaded at the longitudinal center thereof on the lower reference finger 44.

(Die shaping device)

A couple of die shaping devices 24 for forming a predetermined profile by the group of upper shaping fingers 30 and that of the lower shaping fingers 72 are disposed on the rear sides of the upper variable die 22 and the lower variable die 23. The die shaping devices 24 are directed to adjust the groups of upper shaping fingers and lower shaping fingers locating on the left side and those locating on the right side of the reference fingers 43 and 44, respectively. Since these die shaping devices 24 are of the same constitution, the constitution of only one device 24 will be described.

A stay 53 is extended between the pillars 21*a* of the main body frame 21, and a pair of guide rails 54 are laid parallelwise along the longitudinal direction of the stay 53 with a predetermined space defined therebetween in the vertical direction, as shown in FIG. 2. A holder 55 is disposed to be slidable along these guide rails 54. A first ball screw 56 is rotatably disposed between these guide rails 54 to be parallel therewith. The first ball screw 56 is screwed into nuts (not shown) provided on the holder 55. Further, a belt 60 is extended across a pulley 57 disposed at a predetermined position of the first ball screw 56 and a pulley 59 fitted on the output shaft of a first servo motor 58 disposed on the stay 53. Accordingly, the holder 55 can be moved horizontally along the guide rails 54 by rotating the first ball screw under driving of the first servo motor 58 in the positive or negative direction. Incidentally, the pulleys 57,59 and the belt 60 employable here are preferably stepped.

Figure 7:
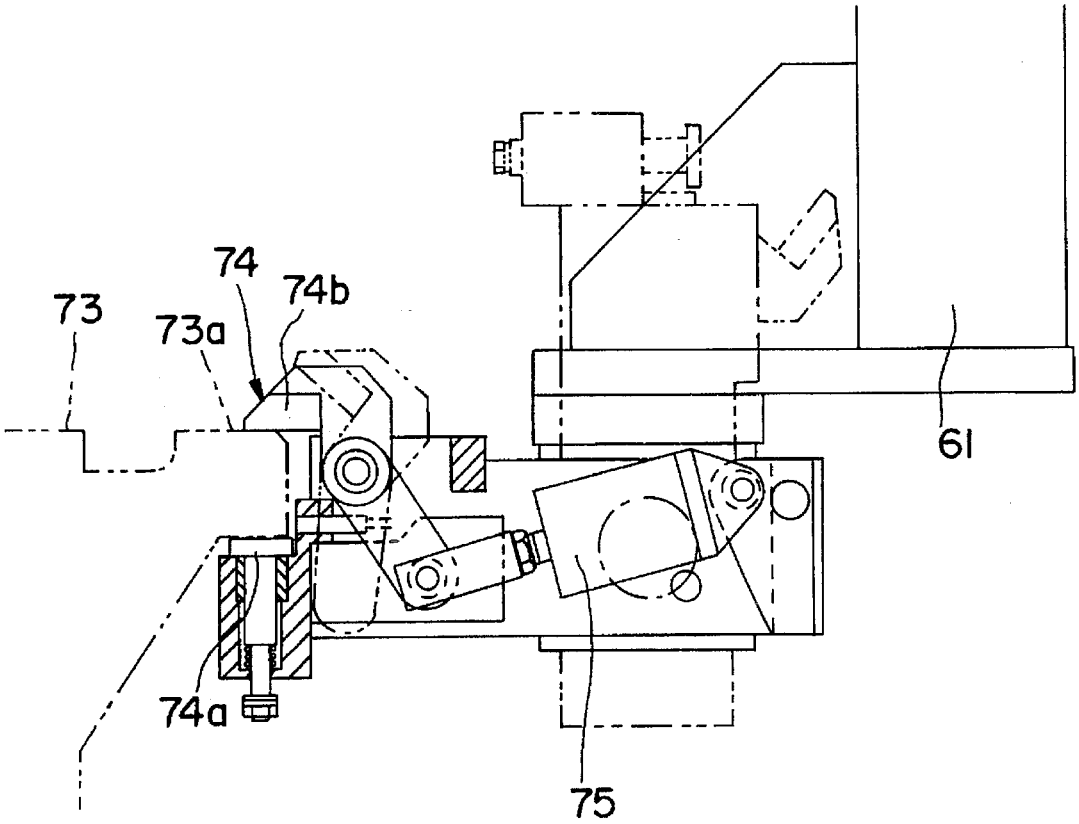
FIG. 7 is a side view of the major section of an adjusting jaw in a die shaping device.

An adjusting member 61 is descendably disposed on the holder 55. A nut 62 is disposed on the adjusting member 61, and a second ball screw 63 disposed vertically in the holder 55 is screwed into this nut 62. A second servo motor 64 is disposed invertedly on the upper surface of the holder 55, and the second ball screw 63 is connected to the motor 64. Accordingly, the adjusting member 61 can be ascended or descended perpendicularly by rotating the ball screw 63 under driving of the second servo motor 64 in the positive or negative direction (see FIGS. 9 and 10). An adjusting jaw 74 is disposed at the lower end of the adjusting member 61, as shown in FIG. 7. The adjusting jaw 74 consists of a fixed jaw 74*a* protruding toward the front side and a movable jaw 74*b* which can be pivoted in the positive or negative direction by operating a cylinder 75 positively or negatively. In the adjusting jaw 74, the engagement piece 73*a* of the lower side plate 73 disposed to a lower shaping finger 72 is designed to be chucked between the fixed jaw 74*a* and the movable jaw 74*b*. Namely, the position of the lower shaping finger 72 with the engagement piece 73*a* thereof being chucked between the fixed jaw 74*a* and the movable jaw 74*b* can be adjusted by moving the adjusting member 61 vertically by the second servo motor 64.

Figure 11:
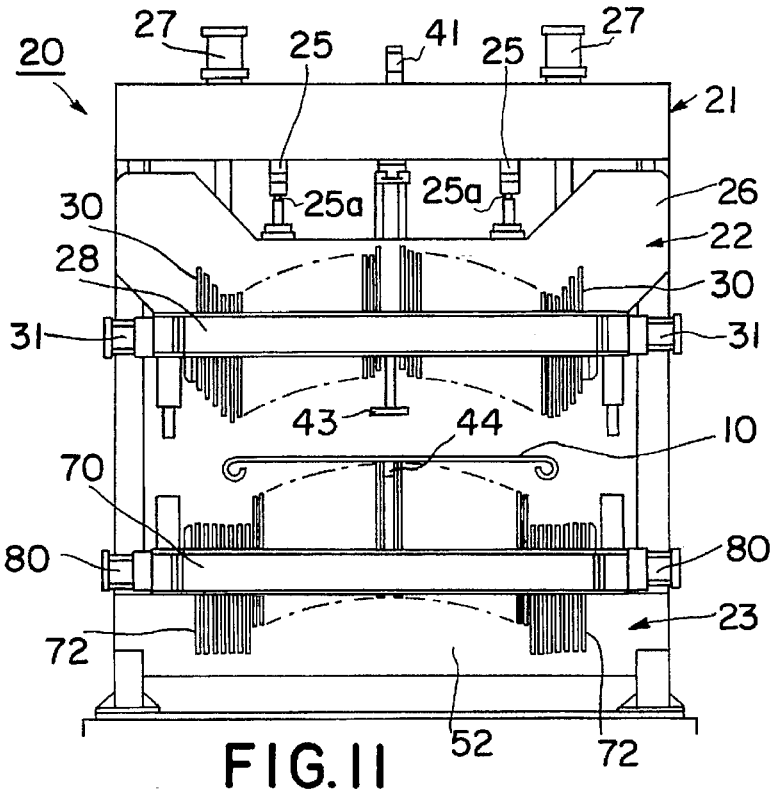
FIG. 11 is an explanatory view showing a straight leaf spring blank loaded between the upper variable die and the lower variable die.

It should be noted that in the die shaping device 24, the position of a lower shaping finger 72 is designed to be adjusted, after the lower shaping finger 72 is ascended by the adjusting member 61 to allow the engagement piece 73*a* of the lower side plate 73 thereof to abut against an engagement piece 38*a* of the upper side plate 38 in the corresponding upper shaping finger 30 and the position of the upper shaping finger 30 is adjusted via the lower shaping finger 72. Thus, a required continuous die profile can be formed as a whole by the opposing ends of the respective groups of shaping fingers by adjusting the positions of the upper shaping fingers 30 and the lower shaping fingers 72, as shown in FIG. 11.

The first servo motor 58 and the second servo motor 64 are respectively provided with position detectors (not shown) for detecting the current position of the holder 55 and that of the adjusting jaw 74 by detecting the revolution of the servo motors 58,64, so that the accurate position of the holder 55 and that of the adjusting jaw 74 may constantly be monitored. Signals on the current position of the holder 55 and that of the adjusting jaw 74 from the position detectors are input, for example, to a control means (not shown) having a built-in microcomputer. Accordingly, the driving of the respective servo motors 58,64 can be controlled based on the desired camber profile data input beforehand to the control means, and the desired die profile can easily be formed by the group of upper shaping fingers 30 and the group of the lower shaping fingers 72.

Figure 9A:
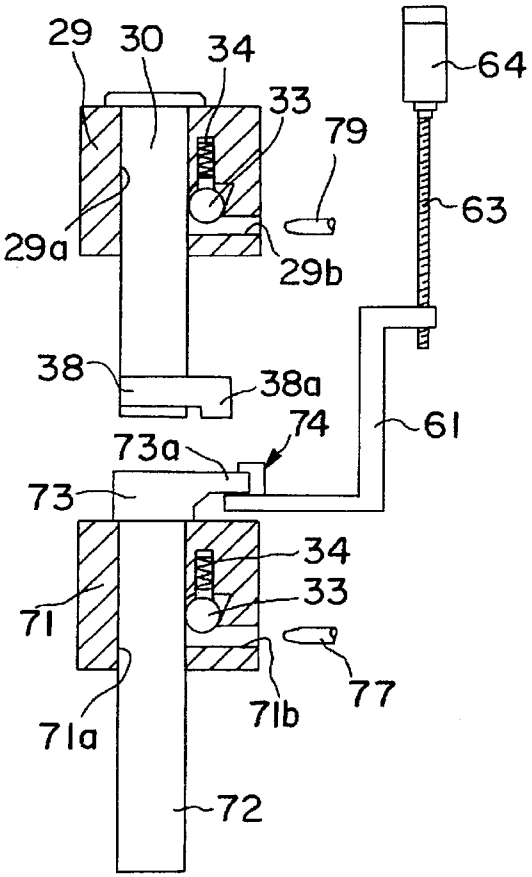
FIG. 9 is an explanatory view showing the process that the position of the upper shaping finger and that of the lower shaping finger are adjusted by the die shaping device so that the upper and lower shaping fingers are raised, wherein FIG. 9(*a*) shows the initial positions thereof, FIG. 9(*b*) shows an intermediate positions thereof with the lower shaping finger in contact with the upper shaping finger, and FIG. 9(*c*) shows the final positions thereof.
Figure 9B:
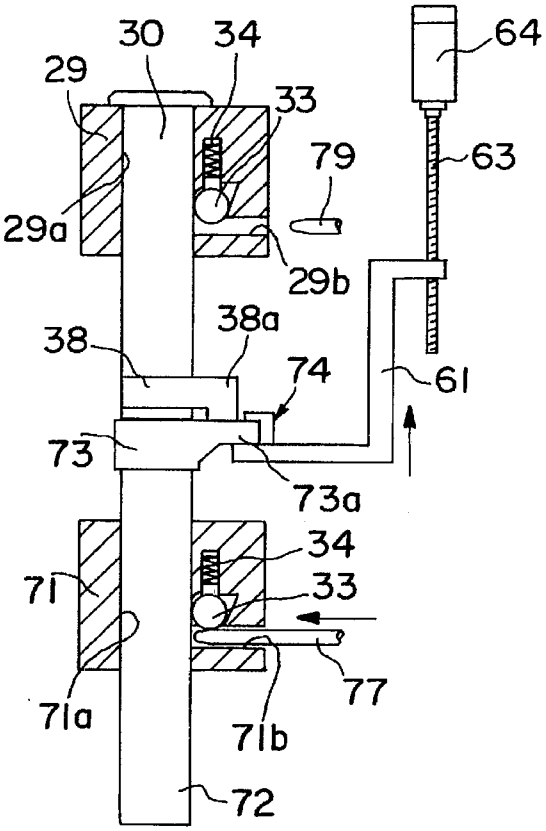
Figure 9C:
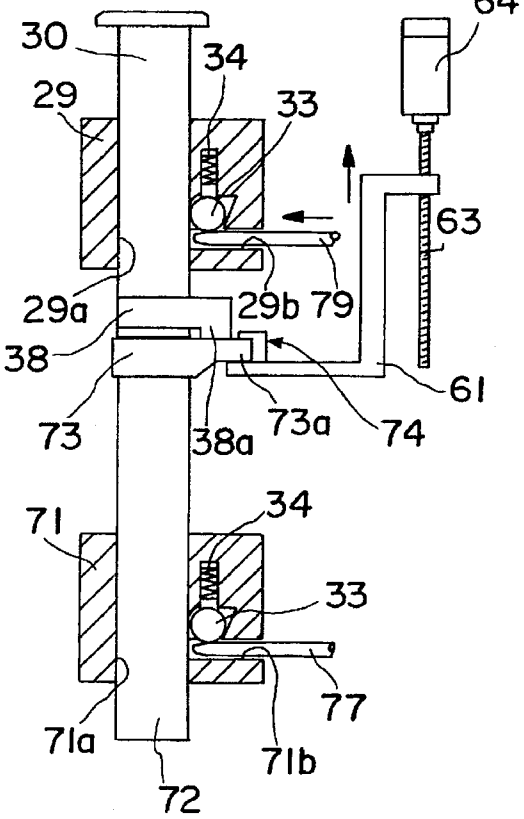

A lower air cylinder 76 is disposed on the rear side of the holder 55 at a position where it can oppose to a through hole 71*b* (shift regulating mechanism) defined in each lower supporting member 71 of the lower variable die 23, as shown in FIG. 2, so that a release pin 77 provided on the piston rod of the cylinder 76 can be inserted to the through hole 71*b*. An upper air cylinder 78 is also disposed on the holder 55 above the lower air cylinder 76 with a predetermined space defined therebetween. The upper air cylinder 78 is designed to oppose to the through hole 29*b* defined in the corresponding upper supporting member 29 in the state where the upper variable die 22 is positioned at the target position. The release pin 79 provided on the piston rod of the air cylinder 78 is designed to be inserted to the through hole 29*b*. Namely, by operating the respective air cylinders 78,76 such that the piston rods thereof may be extended outward, the release pins 79,77 can be inserted to the through holes 29*b*, 71*b* of the supporting members 29,71, respectively, as shown in FIG. 9(*c*). Thus, the cylindrical bodies 33 in the shift regulating mechanisms of the shaping fingers 30,72 can be moved to the regulation releasing positions where the shaping fingers 30,72 are allowed to move freely along the U-shaped grooves 29*a*,71*a*, respectively.

(Action of the embodiment)

Now, actions of the thus constituted cambering apparatus will be described. Before the cambering apparatus 20 is operated, predetermined camber profile data such as the length of the leaf spring blank 10 and camber profile are input to the control means provided in the cambering apparatus 20. Meanwhile, the upper variable die 22 is descended to the target position to assume a stand-by posture so that adjustment of the position of the group of shaping fingers may be carried out.

In the upper variable die 22, the couple of upper hydraulic cylinders 31 disposed at each end of the upper guide members 28 are operated such that the piston rods 31*a* thereof may be retracted into the barrels to release the nipping pressure applied to the group of upper supporting members disposed to be slidable along the upper guide members 28. Thus, every two adjacent upper supporting members 29 are spaced from each other under the resilience of the plurality of compression springs 44 disposed in every other upper supporting members 29 in the group of upper supporting members 29 to allow free adjustment of the upper shaping fingers 30. Likewise, in the lower variable die 23, the couple of lower hydraulic cylinders 80 disposed on each end of the lower guide members 70 are operated such that the piston rods 80*a* thereof may be retracted into the barrels to release the nipping force applied to the group of lower supporting members 71 disposed to be slidable along the lower guide members 70. Thus, the lower shaping fingers 72 assume a state where they allow free adjustment of the positions thereof.

The servo motors 58,64 for driving each of the die shaping devices 24 disposed on each side relative to the machine center are driven under control based on the input data so as to carry out adjustment of the positions of the shaping fingers 30,72 supported on the supporting members 29,71, respectively.

To describe more specifically, the first servo motor 58 is operated to move the holder 55 horizontally to be positioned behind a lower shaping finger 72 to be adjusted. The fixed jaw 74*a* of the adjusting member 61 is allowed to stay below the engagement piece 73*a* of the lower side plate 73 attached to this lower shaping finger 72. Further, the movable jaw 74*b* is pivoted by operating the cylinder 75 so as to chuck the engagement piece 73*a* in cooperation with the fixed jaw 74*a* (see FIG. 7). The lower air cylinder 76 disposed on the holder 55 is operated to insert the release pin 77 into the through hole 71*b* of the lower supporting member 71, as shown in FIG. 9(*b*). Thus, the regulation applied to the lower shaping finger 72 by the shift regulating mechanism disposed in the lower supporting member 71 is released to allow the finger 72 to ascend or descend freely in the U-shaped groove 71*a* defined in the lower supporting member 71.

Under the state where the lower shaping finger 72 is allowed to be movable with respect to the lower supporting member 71 as described above, the second servo motor 64 is operated to ascend the adjusting jaw 74 chucking the engagement piece 73*a* therebetween. Thus, the lower shaping finger 72 slides in the U-shaped groove 71*a* of the lower supporting member 71, and the engagement piece 73*a* is finally abutted against the engagement piece 38*a* in the upper side plate 38 of the corresponding upper shaping finger 30, as shown in FIG. 9(*c*). In this state, the upper air cylinder 78 disposed on the holder 55 is operated to insert the release pin 79 into the through hole 29*b* of the upper supporting member 29. Thus, the regulation applied to the upper shaping finger 30 by the shift regulating mechanism disposed in the upper supporting member 29 is released to allow the finger 30 to ascend or descend freely in the U-shaped groove 29*a*. Subsequently, the finger 30 is allowed to slide in the U-shaped groove 29*a* of the upper supporting member 29 by moving the adjusting jaw 74 toward the target position of the upper shaping finger 30 and finally shifted to a predetermined position (see FIG. 10(*a*)). At the stage where the adjustment of the upper shaping finger 30 is completed, the release pin 79 inserted to the through hole 29*b* is withdrawn, and thus the corresponding cylindrical body 33 is brought into press contact with the lateral surface of the upper shaping finger 30 locating in the U-shaped groove 29*a* under the action of the compression spring 34 and wedge 35. Thus, the upper shaping finger 30 can be positioned in the state where shifting thereof is regulated with respect to the upper supporting member 29.

Figure 10A:
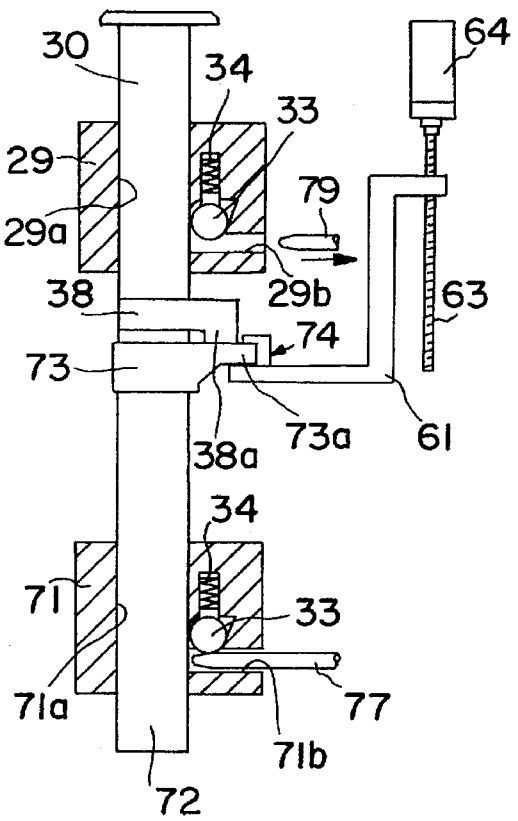
FIG. 10 is an explanatory view showing the process that the position of the upper shaping finger and that of the lower shaping finger are adjusted by the die shaping device so that the upper and lower shaping fingers are lowered, wherein FIG. 10(*a*) shows the initial positions thereof, FIG. 10(*b*) shows an intermediate positions thereof with the lower shaping finger separated from the upper shaping finger, and FIG. 10(*c*) shows the final positions thereof.
Figure 10B:
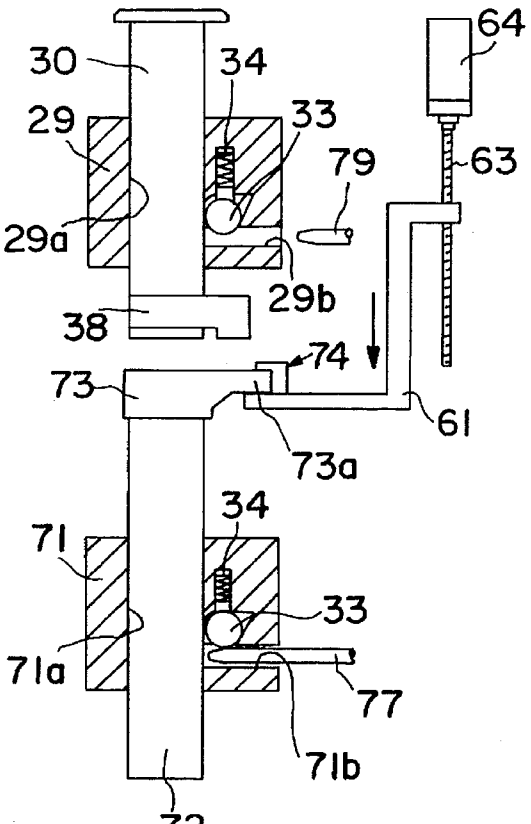
Figure 10C:
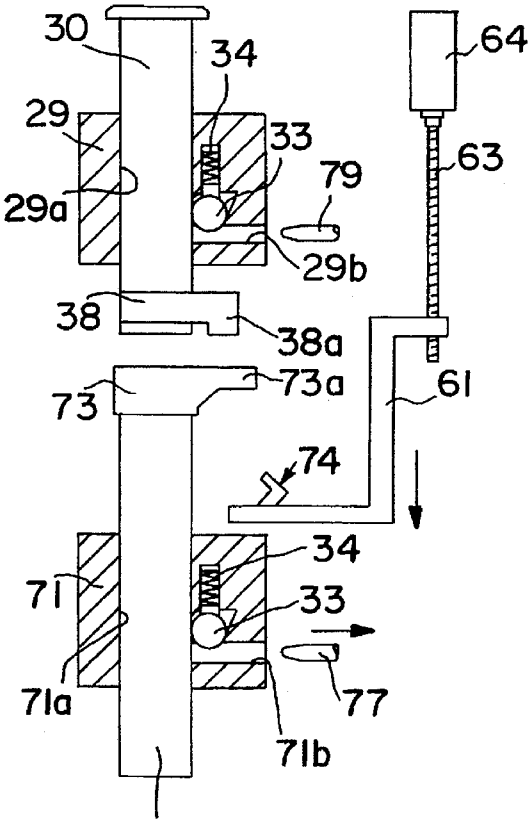

Next, when the second servo motor 64 is operated so as to move the adjusting jaw 74 to the target position of the lower shaping finger 72, the finger 72 slides in the U-shaped groove 71*a* of the lower supporting member 71 and finally shifted to a predetermined position (see FIG. 10(*b*)). At the stage where the adjustment of the lower shaping finger 72 is completed, the release pin 77 inserted to the through hole 71*b* is withdrawn, as shown in FIG. 10(C), and thus the corresponding cylindrical body 33 is brought into press contact with the lateral surface of the lower shaping finger 72 locating in the U-shaped groove 71*a* under the action of the compression spring 34 and wedge 35. Thus, the lower shaping finger 72 can be positioned in the state where shifting thereof is regulated with respect to the lower supporting member 71.

By adjusting a required number of upper and lower shaping fingers 30,72 as described above, the contours formed by the ends of upper and lower group of shaping fingers respectively present as a whole the desired die profile, as shown in FIG. 11. If the hydraulic cylinders 31,80 are operated in this state such that the piston rods 40*a*,80*a* thereof may be extended outward, the groups of supporting members disposed to the guide members 28,70 are brought together to unmovably hold the shaping fingers 30,72 tightly. Incidentally, those upper and lower shaping fingers 30,72 opposing to the "eye" formed at the end portion or portions of the leaf spring blank 10 are to be retracted beforehand to the positions where they do not interfere with the leaf spring blank 10.

Subsequently, a straight leaf spring blank 10 heated to a predetermined temperature is loaded at the longitudinal center thereof onto the lower reference finger 44, and the positioning cylinder 41 is operated to descend the upper reference finger 43 until the leaf spring blank 10 is held tightly at the center thereof between these reference fingers 44,43.

Figure 12:
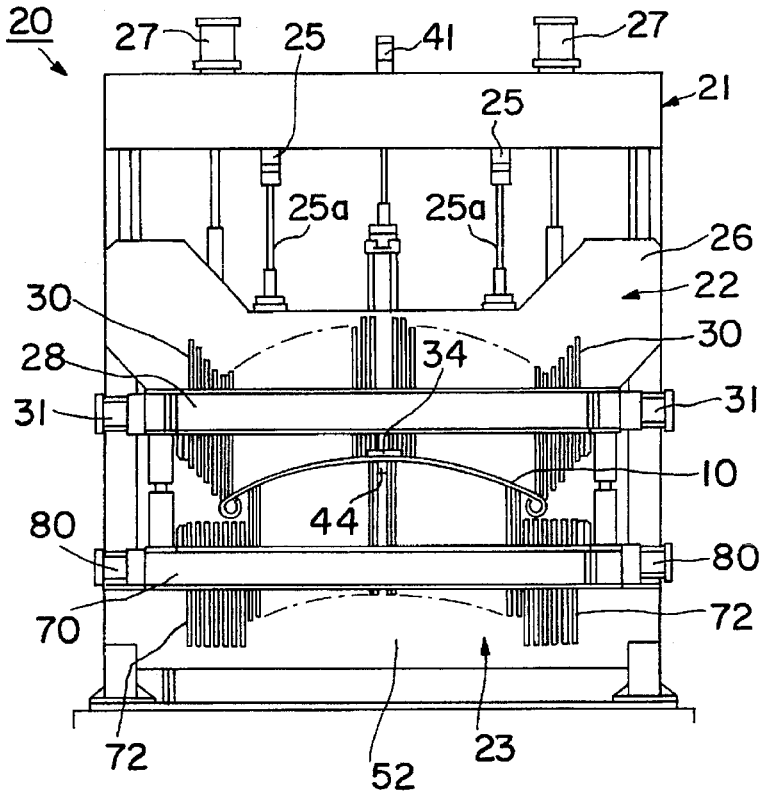
FIG. 12 is an explanatory view where a predetermined camber is imparted to the leaf spring blank by forcing the upper variable die to approach the lower variable die.
Figure 13:
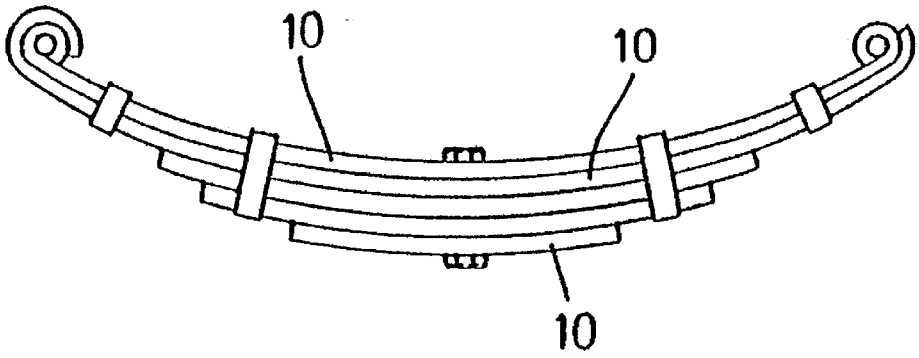
FIG. 13 is an explanatory view of a suspension system using leaf springs.
Figure 14:
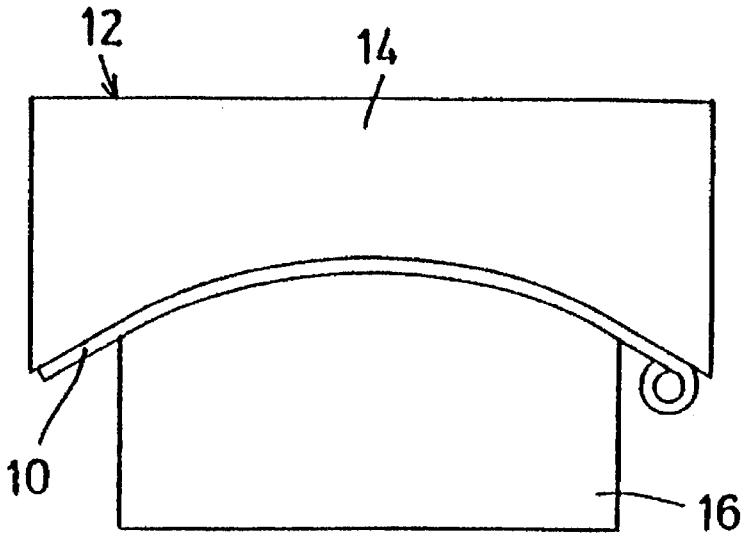
FIG. 14 is an explanatory view of a prior art cambering apparatus.

The couple of hydraulic cylinders 25 disposed to the main body frame 21 are operated so as to descend the movable frame 26 along the pillars 21*a*, as shown in FIG. 12, and thus the group of upper shaping fingers 30 forming as a whole a predetermined die profile is brought into press contact with the upper surface of the leaf spring blank 10. Since a die profile is also imparted to the group of lower shaping fingers of the lower variable die 23, the leaf spring blank 10 can be pressed between the group of upper shaping fingers and the group of lower shaping fingers, and thus a camber profile corresponding to the die profile of these groups of shaping fingers can be imparted to the leaf spring blank 10. The thus cambered leaf spring blank 10 is picked out of the cambering apparatus 20, after the movable frame 26 is retracted to assume a stand-by posture, and forwarded to the subsequent steps including quench hardening etc.

Subsequently, if the camber profile and the length of the leaf spring 10 to be formed are changed in accordance with an order change, data on the new die profile are input to the control means (not shown). Thus, the servo motors 58,64 are driven under control based on the input data to form desired die profiles by the group of upper shaping fingers and the group of lower shaping fingers by the die shaping devices 24, respectively, to allow each group of shaping fingers to present as a whole a desired continuous die profile. Namely, a desired die profile can be formed by the group of upper shaping fingers and the group of lower shaping fingers merely by inputting data on the desired camber profile to the control means, leading to reduction of the time required for the order change, in turn, to improvement of production efficiency. Besides, there is no need of providing a number of upper dies and lower dies corresponding to the camber profiles, so that the production cost can be reduced and that the intricate stock management can be eliminated, advantageously. Further, if it is found that a leaf blank 10 having underwent the cambering process is not cambered correctly through an inspection thereof, when a predetermined lot of leaf springs 10 are to be formed, the die profiles of the variable dies can be corrected in a very short time by operating the die shaping devices 24, leading to improvement of production efficiency. Moreover, since the upper shaping fingers 30 are designed to be adjusted with the aid of the lower shaping fingers 72, the number of die shaping devices 24 which must be provided can be minimized, so that the facility cost can be reduced advantageously.

Further, in the case where a single or a very few leaf springs 10 are to be formed as prototypes and the like, there is no need of producing many kinds of upper dies and lower dies corresponding to the camber profiles, because desired die profiles can easily be formed. Accordingly, the running cost can be reduced. If data on a plurality of camber profiles are input beforehand to the control means so that a desired camber profile can be selected merely by depressing a predetermined setting button in accordance with an order change, the time required for the adjustment can further be reduced. In addition, since the constitution of the positioning means (shift regulating mechanisms) of the shaping fingers 30,72 with respect to the supporting members 29,71 is simple, the groups of shaping fingers can be immobilized firmly by the hydraulic cylinders 31,81, respectively, and thus the positioning means are prevented from being damaged by the load applied thereto when cambering is to be carried out by the variable shaping dies 22,23.

Incidentally, in the embodiment described above, while the positions of the multiplicity of shaping fingers in the upper and lower variable dies are adapted to be adjusted by two die shaping devices, the present invention is not to be limited to such embodiment, but the positions of all the shaping fingers may be adjusted by one die shaping device, or three or more die shaping devices may be provided. Alternatively, the positions of the upper shaping fingers in the upper variable die and those of the lower shaping fingers in the lower variable die may be adapted to be adjusted by specialized die shaping devices, respectively.

Further, since the upper and lower variable dies can be positioned automatically based on the numerical data input beforehand, change of die profiles in accordance with an order change can be carried out in a short time. Besides, no operator participates in the adjusting operation, so that the labor and energy can be saved. The facility cost can also be minimized, because the positions of the upper and lower shaping fingers can be adjusted by one die shaping device.

It should be apparent to those skilled in the art that the present invention may be embodied in many other specific forms without departing from the spirit or scope of the invention. Therefore, the present embodiments are to be considered as illustrative, and the invention is not to be limited to the details given herein, but may be modified within the scope of appended claims.

What is claimed is:

1. A cambering apparatus for imparting a predetermined camber to a leaf spring blank loaded between a pair of dies opposing vertically to each other by bringing said dies closer relative to each other; said apparatus essentially comprising an upper variable die and a lower variable die; said upper variable die consisting of:

a pair of upper guide members secured on a movable frame descendably disposed on a main body frame, and extended in the longitudinal direction of said leaf spring blank;

a multiplicity of upper supporting members disposed on said upper guide members to be slidable in the longitudinal direction thereof;

an upper shaping finger fitted descendably in a U-shaped groove defined on that side of each upper supporting member which opposes to one of adjacent two upper supporting members, at least two upper shaping fingers provided thereby defining a group of upper shaping fingers;

a regulating member disposed on each of said upper supporting members, which is normally abutted against a corresponding upper shaping finger provided in said U-shaped groove and which can be shifted by a releasing means to a position where it allows descending of said upper shaping finger; and a pair of releasable upper immobilizing means disposed on said movable frame, which brings said multiplicity of upper supporting members into press contact with one another so as to unmovably position said group of upper shaping fingers;

whereas said lower variable die consisting of:

a pair of lower guide members secured on a fixed frame disposed on said main body frame and under said movable frame so as to oppose vertically thereto and extended in the longitudinal direction of said leaf spring blank;

a multiplicity of lower supporting members disposed on said lower guide members to be slidable in the longitudinal direction thereof;

a lower shaping finger fitted ascendably in a U-shaped groove defined on that side of each lower supporting member which opposes to one of adjacent two lower supporting member, at least two lower shaping fingers provided thereby defining a group of lower shaping fingers;

a regulating member disposed in each of said lower supporting members, which is normally abutted against a corresponding lower shaping finger provided in said U-shaped groove and which can be shifted by a releasing means to a position where it allows descending of said lower shaping finger; and a pair of releasable lower immobilizing means disposed on said fixed frame, which bring said multiplicity of lower supporting members into press contact with one another so as to unmovably position said group of lower shaping fingers; and wherein a die shaping device is disposed in said main body frame, said die shaping device for ascending or descending said shaping fingers in said upper and lower variable dies onto said supporting members respectively so as to form a predetermined die profile by each of said upper and lower groups of shaping fingers along an opposing ends of said upper and lower groups of shaping fingers.

2. The cambering apparatus according to claim 1, wherein said die shaping device is provided with a couple of servo means which control the movement of an adjusting means for positioning said upper and lower shaping fingers.

3. The cambering apparatus according to claim 2, wherein each upper shaping finger and each lower shaping finger (72) are provided with an engagement piece, respectively, which can be abutted against each other when said fingers are brought closer to each other; the positions of said upper shaping finger engaged with said lower shaping finger by said engagement pieces are adapted to be adjusted by operating said adjusting means, with said adjusting means of said shaping device being engaged with said engagement piece of said lower shaping finger, followed by adjustment of the positions of said lower shaping fingers.

* * * * *